US008914914B1

(12) United States Patent
Blake

(10) Patent No.: US 8,914,914 B1
(45) Date of Patent: Dec. 23, 2014

(54) HAT WITH HAIR KEEPING DEVICE

(76) Inventor: Rochelle Blake, Newark, NJ (US)

( * ) Notice: Subject to any disclaimer, the term of this patent is extended or adjusted under 35 U.S.C. 154(b) by 166 days.

(21) Appl. No.: 13/606,963

(22) Filed: Sep. 7, 2012

(51) Int. Cl.
*A42B 1/00* (2006.01)
*A42B 1/04* (2006.01)
*A42B 1/06* (2006.01)

(52) U.S. Cl.
CPC .. *A42B 1/04* (2013.01); *A42B 1/069* (2013.01)
USPC ..... 2/175.1

(58) Field of Classification Search
CPC ..... A41D 2300/33; A42B 1/04; A42B 1/043; A42B 1/069; A42B 1/16; A42B 1/18; A42B 1/22; A42B 1/225
USPC ..... 2/63, 68, 171.4, 171.5, 171.7, 183, 174, 2/202, 206, 175.4
See application file for complete search history.

(56) References Cited

U.S. PATENT DOCUMENTS

| | | | | | |
|---|---|---|---|---|---|
| 750,992 | A * | 2/1904 | Mayer | 2/175.4 |
| 807,952 | A * | 12/1905 | Mayer | 2/175.4 |
| 888,902 | A * | 5/1908 | Jaillet et al. | 2/171.5 |
| 1,145,765 | A * | 7/1915 | Grunig et al. | 2/181 |
| 1,211,075 | A * | 1/1917 | Burns | 2/183 |
| 1,225,618 | A * | 5/1917 | Grunig et al. | 2/183 |
| 1,275,238 | A * | 8/1918 | Freeman | 2/171.5 |
| 1,393,652 | A * | 10/1921 | Van Huele | 2/181 |
| 1,511,129 | A * | 10/1924 | McKnight | 2/181 |
| 1,534,181 | A * | 4/1925 | Krainer | 2/183 |
| 1,557,280 | A * | 10/1925 | Watson | 2/181 |
| 1,684,610 | A * | 9/1928 | Weir | 2/181 |
| 1,725,425 | A * | 8/1929 | Steingold | 2/181 |
| 1,981,286 | A | 11/1934 | Reynolds | |
| 1,992,285 | A * | 2/1935 | Blum | 2/183 |
| 2,052,123 | A * | 8/1936 | Adamson | 2/171.04 |
| 2,106,570 | A * | 1/1938 | Lipton | 2/175.3 |
| 2,624,052 | A * | 1/1953 | Redlin | 2/204 |
| 3,673,611 | A * | 7/1972 | Cain et al. | 2/175.1 |
| 3,714,670 | A * | 2/1973 | Pollack et al. | 2/183 |
| 5,426,789 | A * | 6/1995 | MacLeod | 2/175.1 |
| 5,488,740 | A * | 2/1996 | Garza | 2/175.1 |
| 5,566,689 | A | 10/1996 | Yeater | |
| 5,890,230 | A * | 4/1999 | Guo | 2/175.1 |
| 6,314,582 | B1 * | 11/2001 | Montague | 2/175.3 |
| 6,553,577 | B2 * | 4/2003 | Montague | 2/175.3 |
| 6,735,783 | B2 | 5/2004 | Phillips | |
| 7,437,777 | B2 * | 10/2008 | Marquardt | 2/202 |
| 7,945,971 | B2 * | 5/2011 | Garza | 2/209.3 |
| 8,375,469 | B2 * | 2/2013 | Duwyn-Zylstra | 2/175.1 |
| 8,627,515 | B1 * | 1/2014 | Scott | 2/175.1 |
| 2001/0025385 | A1 * | 10/2001 | Montague | 2/175.2 |
| 2006/0168709 | A1 * | 8/2006 | Rattay | 2/183 |

(Continued)

*Primary Examiner* — Alissa L Hoey
(74) *Attorney, Agent, or Firm* — Crossley Patent Law

(57) ABSTRACT

A hat with hair keeping device including an outer layer with a crown, a continuous side wall, a front portion, rear portion and a brim. An inner layer is disposed within the outer layer. The inner layer has upper, forward, and rearward portions. Parallel lower and upper seams are continuously disposed between the continuous side wall and the brim with a cinching body continuously disposed within the lower and upper seams. There is an opening disposed in the rear portion of the outer layer. The opening is configured to receive a portion of the cinching body there through with the drawstring secured posteriorly to the rearward portion of the outer layer by tying the ends of the drawstring together. The silk or satin inner layer reduces hair breakage by reducing friction against the hair and helps avoid perspiration around the hairline, thus assisting in keeping the hairstyle intact.

1 Claim, 2 Drawing Sheets

(56) References Cited

U.S. PATENT DOCUMENTS

2007/0118970 A1* 5/2007 Gerstel Costello ..... 2/195.2
2007/0220663 A1* 9/2007 Picotte ..... 2/414
2008/0010721 A1* 1/2008 Campbell et al. ..... 2/181.4
2008/0235851 A1* 10/2008 Grey ..... 2/174
2009/0151048 A1* 6/2009 Laury ..... 2/202
2010/0192282 A1 8/2010 Matthews
2011/0099691 A1* 5/2011 Duwyn-Zylstra ..... 2/175.1
2013/0298929 A1* 11/2013 Cole ..... 132/200

* cited by examiner

HAT WITH HAIR KEEPING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of hair-keeping hats are known in the prior art. However, what is needed is a hat with hair keeping device having a drawstring that assists in wrapping relaxed or straight hair and secures the hair within the hat to protect the hair from breakage and to maintain the hair style.

FIELD OF THE INVENTION

The present invention relates to a hairstyling hat, and more particularly, to a hat with hair keeping device for wrapping relaxed or straight hair to secure the hair in place protecting the hair from breakage and to maintain the style.

SUMMARY OF THE INVENTION

The general purpose of the present hat with hair keeping device, described subsequently in greater detail, is to provide a hat with hair keeping device which has many novel features that result in a hat with hair keeping device which is not anticipated, rendered obvious, suggested, or even implied by prior art, either alone or in combination thereof.

To accomplish this, the present hat with hair keeping device includes an outer layer. The outer layer has a crown, a continuous side wall, and a brim. The outer layer has a front portion and a rear portion. An inner layer is disposed within the outer layer. The inner layer has an upper portion, a forward portion, and a rearward portion. The inner layer is formed of silk and alternately is formed of satin. The outer layer can be formed of a fabric blend of cotton and polyester.

Parallel lower and upper seams are continuously disposed between the continuous side wall and the brim. A pocket is continuously disposed between the lower seam and upper seam. A cinching body is continuously disposed within the pocket. The cinching body is a drawstring and can alternately be elastomeric.

There is an opening disposed in the rear portion of the outer layer. The opening is configured to receive a portion of the cinching body there through. The drawstring is secured posteriorly to the rearward portion of the outer layer by tying the ends of the drawstring together.

The silk, and alternate satin, inner layer reduces hair breakage by reducing friction against the hair and, in addition, helps avoid perspiration around the hairline, thus assisting in keeping the user's hairstyle intact.

Thus has been broadly outlined the more important features of the present hat with hair keeping device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
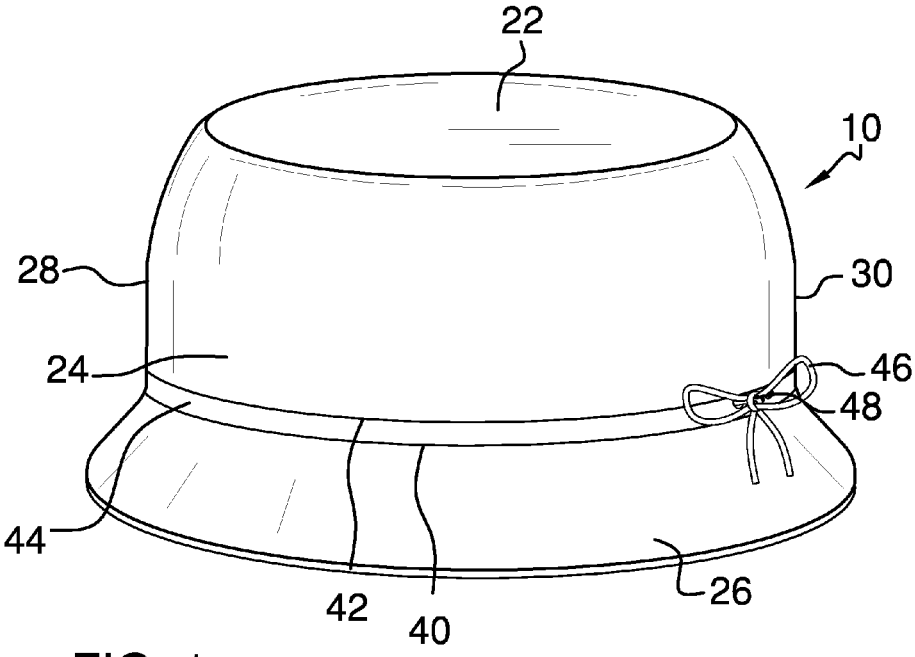
FIG. 1 is an isometric view.
Figure 2:
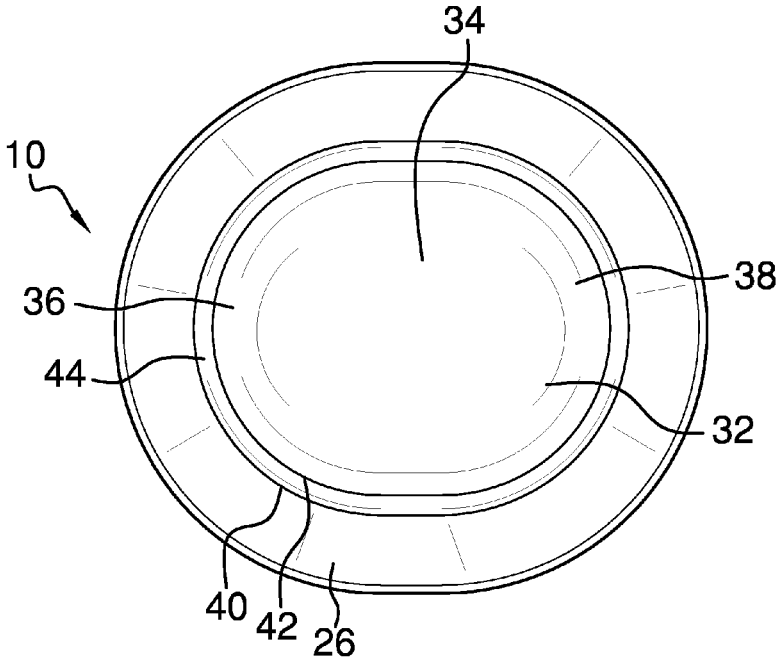
FIG. 2 is a bottom view.
Figure 3:
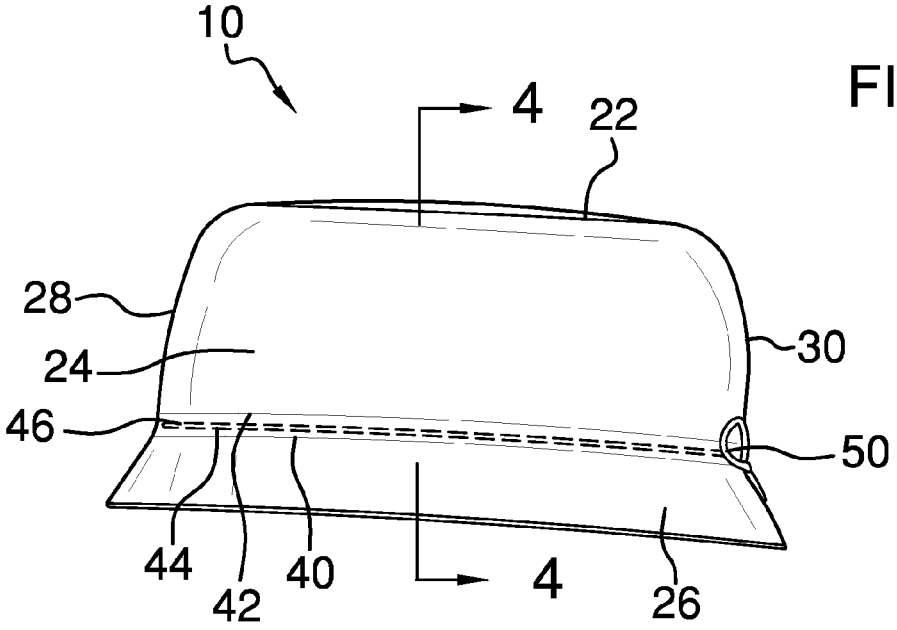
FIG. 3 is a side view.
Figure 4:
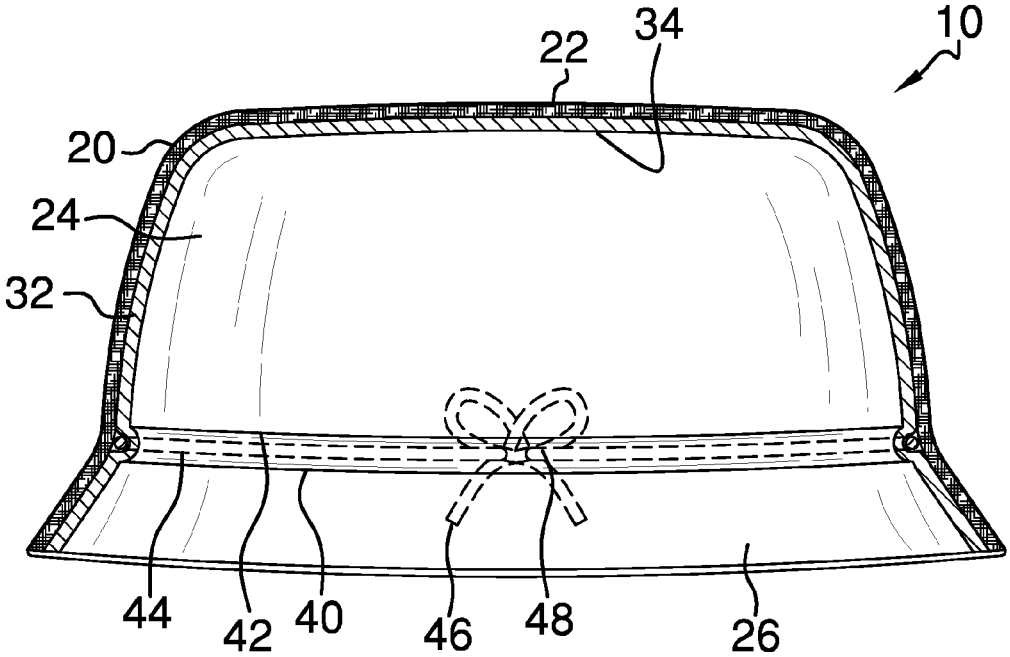
FIG. 4 is a cross sectional view taken along line 4-4 of FIG. 3.

With reference now to the drawings, and in particular FIGS. 1 through 4 thereof, example of the instant hat with hair keeping device employing the principles and concepts of the present hat with hair keeping device and generally designated by the reference number 10 will be described.

Referring to FIGS. 1 through 4 a preferred embodiment of the present hat with hair keeping device 10 is illustrated. The hat with hair keeping device 10 includes an outer layer 20. The outer layer 20 has a crown 22, a continuous side wall 24, and a brim 26. The outer layer 20 has a front portion 28 and a rear 30 portion. An inner layer 32 is continuously disposed within the entire outer layer 20. The inner layer 32 has an upper portion 34, a forward portion 36, and a rearward portion 38. The inner layer 32 is formed of silk and alternately is formed of satin. The outer layer 20 can be formed of a fabric blend of cotton and polyester.

A lower seam 40 is continuously disposed between the continuous side wall 24 and the brim 26. An upper seam 42 is continuously disposed on the continuous side wall 24 in a position parallel to the lower seam 40. A pocket 44 is continuously disposed between the lower seam 40 and the upper seam 42. A cinching body 46 is continuously disposed within the pocket 44. The cinching body 46 is a drawstring 48 and can alternately be elastomeric.

An opening 50 disposed in the rear portion 30 of the outer layer 20. The opening 50 is configured to receive a portion of the cinching body 46 there through. The drawstring 48 is secured posteriorly to the rearward portion 38 of the outer layer 20 by tying the ends of the drawstring 48 together.

The silk, and alternate satin, inner layer 32 reduces hair breakage by reducing friction against the hair and, in addition, helps avoid perspiration around the hairline, thus assisting in keeping the user's hairstyle intact.

What is claimed is:

1. A hat with hair keeping device consisting of:

an outer layer having a crown, a continuous side wall, and a brim;

wherein the outer layer has a front portion and a rear portion;

an inner layer continuously disposed within the entire outer layer;

wherein the inner layer has an upper portion, a forward portion, and a rearward portion;

wherein the inner layer is formed of silk and alternately is formed of satin;

a lower seam continuously disposed between the continuous side wall and the brim;

an upper seam continuously disposed on the continuous side wall in a position parallel to the lower seam;

a pocket continuously disposed between the lower seam and the upper seam;

a cinching body continuously disposed within the pocket, wherein the cinching body is a drawstring;

an opening disposed in the rear portion of the outer layer;

wherein the opening is configured to receive a portion of the cinching body there through;

wherein the drawstring is secured posteriorly to the rearward portion of the outer layer; and wherein the outer layer is formed of a fabric blend of cotton and polyester.

* * * * *